US006904706B2

(12) United States Patent
Jones et al.

(10) Patent No.: US 6,904,706 B2
(45) Date of Patent: Jun. 14, 2005

(54) SANDAL, THONG OR THE LIKE WITH REVERSIBLE TONGUE, VAMP, OR STRAP

(75) Inventors: Lindell B. Jones, Chesterfield, MO (US); Raymond F. Tonkel, Sudbury, MA (US)

(73) Assignee: U Turn Sports Co., LLC Mo LLC., Chesterfield, MO (US)

( * ) Notice: Subject to any disclaimer, the term of this patent is extended or adjusted under 35 U.S.C. 154(b) by 0 days.

(21) Appl. No.: 10/771,196

(22) Filed: Feb. 3, 2004

(65) Prior Publication Data

US 2004/0172852 A1 Sep. 9, 2004

Related U.S. Application Data

(63) Continuation-in-part of application No. 10/437,140, filed on May 13, 2003, and a continuation-in-part of application No. 10/222,313, filed on Aug. 15, 2002, now abandoned, and a continuation-in-part of application No. 10/122,995, filed on Apr. 11, 2002, now Pat. No. 6,574,887.

(60) Provisional application No. 60/285,693, filed on Apr. 24, 2001.

(51) Int. Cl.[7] ..... A43B 3/12; A43B 3/10; A43B 5/08; A43B 3/24

(52) U.S. Cl. ..... 36/11.5; 36/7.5; 36/8.1; 36/101

(58) Field of Search ..... 36/11.5, 7.5, 87, 36/8.1, 101

(56) References Cited

U.S. PATENT DOCUMENTS

| | | | | |
|---|---|---|---|---|
| 1,844,997 A | | 2/1932 | Weigle | |
| 2,049,347 A | | 7/1936 | Benjamin | |
| 3,631,613 A | | 1/1972 | Brettell | |
| 3,928,927 A | * | 12/1975 | Brown et al. | 36/11.5 |
| 3,978,596 A | * | 9/1976 | Brown et al. | 36/11.5 |
| 4,172,330 A | * | 10/1979 | Kao | 36/11.5 |
| 4,372,060 A | | 2/1983 | Adamik | |
| 4,534,122 A | | 8/1985 | MacPhail | |
| 4,630,383 A | | 12/1986 | Gamm | |
| 4,805,321 A | | 2/1989 | Tonkel | |
| 4,864,736 A | * | 9/1989 | Bierk | 36/11.5 |
| 5,052,131 A | * | 10/1991 | Rondini | 36/11.5 |
| 5,094,016 A | | 3/1992 | DiVito | |
| 5,311,679 A | | 5/1994 | Birch, Sr. | |
| 5,379,529 A | | 1/1995 | Smith et al. | |
| 5,410,822 A | | 5/1995 | Vaccari | |
| 5,459,947 A | | 10/1995 | Lasher | |
| 5,615,496 A | * | 4/1997 | Sharpstein | 36/11.5 |
| 5,659,979 A | | 8/1997 | Sileo | |
| 5,673,499 A | | 10/1997 | Attilieni | |
| 6,029,372 A | * | 2/2000 | Pan | 36/11.5 |
| 6,094,841 A | | 8/2000 | Adams | |
| 6,212,797 B1 | | 4/2001 | Merry et al. | |
| 6,237,250 B1 | * | 5/2001 | Aguerre | 36/11.5 |
| 6,321,466 B1 | | 11/2001 | Bordin et al. | |
| 6,397,497 B1 | | 6/2002 | McAtee | |
| 6,574,887 B2 | | 6/2003 | Jones et al. | |

* cited by examiner

*Primary Examiner*—Anthony Stashick
(74) *Attorney, Agent, or Firm*—Paul M. Denk

(57) ABSTRACT

Footwear, in the category of a sandal, and which may include a thong, slide-on, clog, or related structured sandal, wherein one side or the other of a tongue, upper vamp, or sandal strap may be adhered to an upper part of the sandal sole, or its vamp or cross strap, so that one side of the sandal strap structure may be displayed during its wearing, and can be turned to expose its opposite surface for varying the styling of the worn sandal. The tongue, upper vamp, or strap may be secured by a fastening device, such as a swivel, that allows for turning of these components to expose a selected surface in order to vary the aesthetics and appearance of the worn sandal.

4 Claims, 5 Drawing Sheets

SANDAL, THONG OR THE LIKE WITH REVERSIBLE TONGUE, VAMP, OR STRAP

CROSS REFERENCE TO RELATED APPLICATION

This continuation-in-part patent application claims priority as a continuation-in-part of the divisional patent application having Ser. No. 10/437,140, which was filed on May 13, 2003; and is a continuation-in-part of application having Ser. No. 10/222,313, filed on Aug. 15, 2002 now abandoned and also is a continuation-in-part of the regular letters patent application having Ser. No. 10/122,995 filed on Apr. 11, 2002, now U.S. Pat. No. 6,574,887, which application is derived from a provisional application having Ser. No. 60/285,693, filed Apr. 24, 2001; all owned by a common Assignee.

BACKGROUND OF THE INVENTION

This invention relates generally to footwear, and more specifically pertains to footwear in the category of a sandal, thong, slip-on, clog, or the like, or even a beach shoe, wherein the tongue, gusset, upper part of the vamp, or strap, may be reversed, in order to change the aesthetics, coloration, indicia, or other appearance of the overall footwear, when worn.

Obviously, numerous styles of footwear, constructed of various components, for achieving a multitude of purposes, have long been considered in the prior art. Most of these types of innovations have been in the area of running or athletic shoes, which have been substantially in vogue for the past three decades, and wherein various styles or modifications to the shoes, as in their sole configuration, to make them more resilient, or add efficiency to the runner, have been considered in the prior art. In addition, various accessories have been added to footwear, such as adding pockets to the side or quarter portions of the shoe, putting a pocket within the tongue or gusset for the shoe, and these have all been considered in the prior art. For example, see the patent to Adamik, U.S. Pat. No. 4,372,060, relating to this type of technology, and their modifications.

This has even considered reversing various components to footwear, in order to add to their aesthetics, and change their style and appearance, as when worn. For example, the United States patent to Benjamin, U.S. Pat. No. 2,049,347, shows a shoe wherein a strap, held by one or more of D-Rings, can be turned to reverse the positioning of the strap within the shoe structure, as can be noted therein. In addition, the patent to Tonkel, U.S. Pat. No. 4,805,321, shows the use of a separable tongue held by Velcro to its vamp, but which must be removed to provide for its turning and vary the appearance of the shown shoe.

The current invention seeks further modifications to the structure of the identified type of footwear, in order to add further variations in the usage of the shoe, enhance its styling, and further enhance the attractiveness of the sandal, by providing alternative uses and applications to various of its components, when structured into the footwear itself.

SUMMARY OF THE INVENTION

This invention relates to the formation of footwear in general, but more specifically, pertains to the fabrication of what will be generically described as a sandal type of shoe, which may include a sandal, a thong, a slip-on, a clog, and related types of footwear, but having the concept of this invention embodied within its structure, as will be readily determined upon reviewing this invention. In this particular development, a select segment of these types of sandals will be reversible, in its structure, as embodied within the manufactured sandal, so as to provide for a change in the coloration, indicia, design, or to vary other appearance aspects of the sandal, when the structure of this invention is assembled. In the preferred embodiment, there will be a sandal strap, an upper part of a vamp for a sandal, or the upper strap portion of a thong, that will be reversible, in its manipulation, where these types of components can be turned to expose one surface, which may have a stylized and attractive surface provided thereon, or it may be reversed, to furnish an entirely different appearance to the sandal, when worn. This can be done without removal of the reversible structure of the shoe.

This invention primarily relates to the modification to structure in a sandal type of footwear, in general, as fabricated and worn.

Means are provided for accommodating the reversing of these types of components in a sandal, and to hold it to the sole of the shoe, or the front vamp portion, but which components, such as part of a tongue, strap, upper vamp, or the like, can be readily turned, simply upon opening of its fastening feature, which normally holds the components in position, and which incorporate a swivel, that allows for the component to be turned, to achieve these results, as previously reviewed.

The concept of this invention is to provide a link between the shoe component, of that type as previously explained, as being reversible in this concept, such as the upper vamp, strap, tongue, or the like, that lets the wearer reverse these components, as desired, for revealing other coloration, indicia, or design as sought by the wearer. It provides versatility to the usage of the sandal. Such a linkage could be or comprise a short length of cord, it may be an elastic or twistable cord, a resilient cord, or perhaps could comprise a swivel clasp, or any other type or form of clasp, having some degree of flexibility, and which may be twisted or turned, as required. In addition, it may include a clasp, formed of a two-part swivel, that may be interconnected between the lower vamp, and the upper vamp, or it may connect between the sandal strap, and any upper covering portion, such as the upper vamp, or it may comprise a swivel mechanism that connects with the thong stem, the component that normally fits between at least a pair of toes of the wearer, so as to allow for reversing or swiveling of the upper vamp or strap, as may be desired. Furthermore, the swivel may be separable, through the exertion of some amount of force, so that the upper vamp or strap may be removed, and another one relocated, to add further dexterity and versatility to the usage of this invention. In order to prevent the unauthorized removal, or the displacement of the turnable components, for such sandals, as for example, when displayed for sale, the pulling force required to separate the clasp, that forms the swivel, may be excessive, up to seventy to eighty pounds (70 to 80 lbs.) or more of force, or it may only require a slight amount of force, to separate the clasp, at the desire of the manufacturer, the retailer, or even the user, once the shoes are placed in usage. It is also likely that the strap or vamp may be of a compound structure, and have swivel means between each of their sections, which will allow for turning, of just segments, of the gusset or vamp, along its length or height.

It is, therefore, the principal object of this invention to provide a reversible upper vamp, strap, or the like, for sandals, thongs, clogs, beach shoes, and slip-ons.

Another object of this invention is to provide a reversible component for a sandal, that may have difference styles of appearance upon either of its surfaces, so that the upper vamp, strap, or the like, can be reversed, and completely change in appearance and attractiveness for the sandal, at the interest of the footwear user. For example, the consumer can coordinate with team colors, fashion trends, and the like.

Still another object of this invention is to provide footwear, in the category of sandals that incorporates reversible components, of this invention, which adds to the versatility of the appearance and usage of the subject footwear.

Still another object of this invention is to provide a novel swivel that can be used for applying the reversible tongue, gusset, upper vamp, or strap, at the upper central portion of the sandal, to stably hold these components in position and in place, while the shoe is worn, but when opened, can be turned, so as to display different aesthetics.

Still another object of this invention is to provide a usage of a swivel means, in conjunction with the stem of a thong, or with the bottom cap that holds the thong stem in permanent position, so as to allow the turning and reversing of components that secure with the swivel, as integrated into the structure of such a style of footwear.

These and other objects may become more apparent to those skilled in the art upon reviewing the summary of this invention, and upon undertaking a study of the description of its preferred embodiment, in view of the drawings.

BRIEF DESCRIPTION OF THE DRAWINGS

In referring to the drawings,

FIG. 19 shows how a related strap, to that as shown in FIG. 18, can be pivotally connected upon the upward lateral extensions of the sole of the shown shoe, athletic shoe, and the like.

DESCRIPTION OF THE PREFERRED EMBODIMENT

Figure 1:
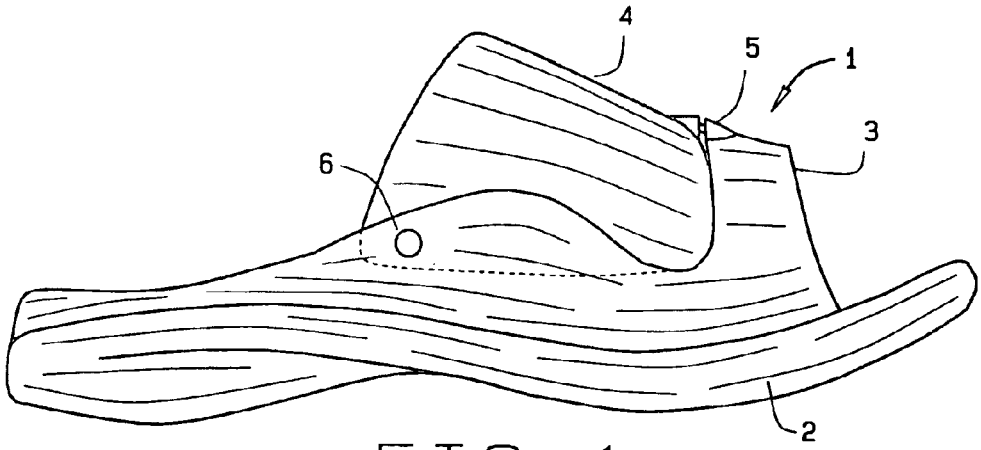
FIG. 1 is a side view of an open-toed sandal implementing a reversible tongue or upper vamp portion according to the present invention.

In referring to the drawings, and in particular FIG. 1, therein is shown the concept of the present invention for incorporating swivel or pivotal components into the structure of a sandal. The sandal as described herein, is used more generically, and generally is intended to describe a slab of leather, polymer, rubber, or the like, for forming a sole and which is attached to the foot by thongs, or the like. Contemporarily, any open shoe whose upper consist of any decorative or functional arrangement, such as straps, are generally identified as a sandal herein, and this may include generically what is defined as a sandal, a thong, clog, or a slip-on, beach shoe, or the like.

In any event, sandal 1 as shown therein comprises a sole portion 2, a sole strap or lower vamp portion 3, and an upper vamp or tongue portion 4 as can be noted. The tongue portion 4 is attached to the strap portion by a retaining means 5, of the type as forming a swivel, or other linking means, as will be subsequently described. The tongue portion 4 is further removably attached to the midsole portion of the shoe sole, by means of a snap 6, as can be noted. One of these will be provided to either side of the shown sandal. However, the present invention is not limited to the usage of a snap, since other types of known attachments devices such as Velcro, or the like, as embodied in a hook and pile type of attachment, can be used for holding the tongue in place, to either side of the shown sandal. The reason for this is that when the fastener is released, on both sides, the tongue or upper vamp 4 may be reversed, through the operations of the swivel or linking means 5, to allow for turning of it to display different coloration or design, for the shown sandal, as desired.

Figure 2:
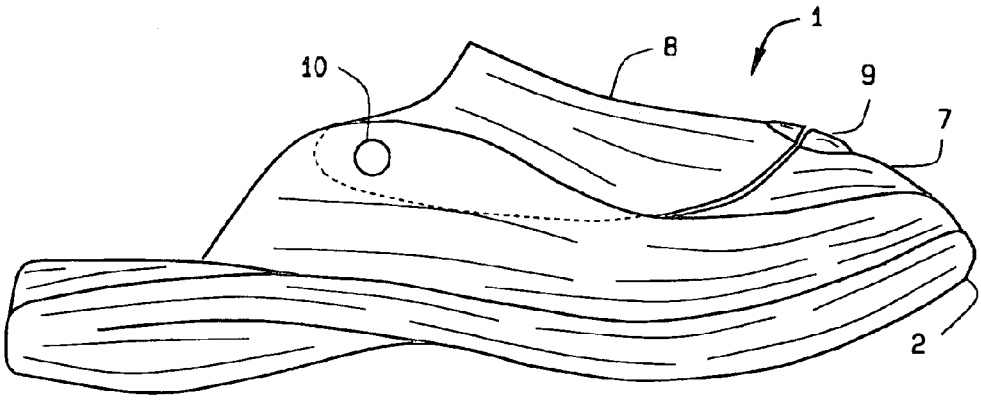
FIG. 2 is a side view of a closed-toed sandal implementing a reversible tongue or upper vamp in accordance with the present invention.

The sandal of FIG. 2 is similar in most respects to the sandal of FIG. 1, except that the vamp portion or toe cap 7 is enlarged to cover the toes of the wearer to resemble a clog-type shoe. In the configuration of FIG. 2, the vamp portion 8 is preferably sized to allow for a larger amount of the tongue portion to be visible, as can be noted. Then, this component 8 may be pivoted, about its swivel 9, as desired, to change the aesthetics of the shown sandal. In addition, a clasp or other fastener of the types as previously reviewed, as noted at 10, may be opened, to allow for reversing of the tongue 8, and once performed, can be refastened in place, through the use of such types of clasps, so that the sandal may be immediately worn, but exhibiting an entirely different style of design, or coloration, as explained.

Figure 3:
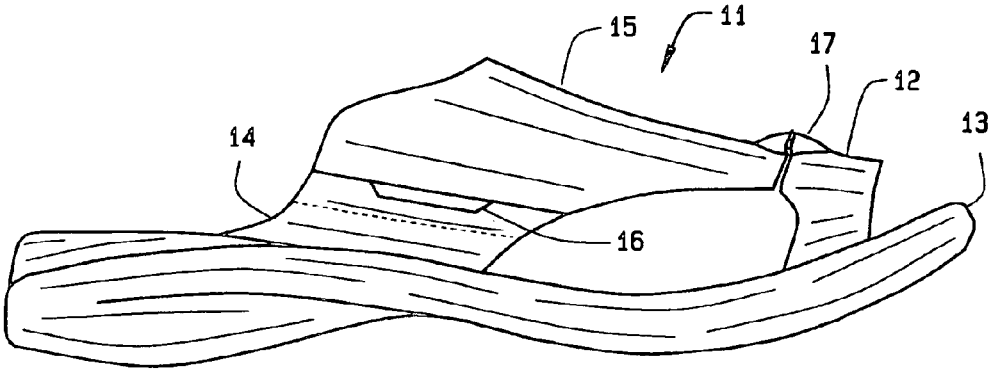
FIG. 3 is a side view of an open-toed sandal implementing a reversible tongue or upper vamp according to the present invention, wherein the vamp portion basically only surrounds the toes of the wearer.

The sandal of FIG. 3, as noted at 11, is of a somewhat different style, in design. For example, it includes a lower vamp or sole strap portion 12 that permanently connects with the sandal sole 13, and then further integrates a pair of shallow quarter portions 14 integrally formed to either side of the sole, and provided for accommodating the removable or reversible connection of the tongue or upper vamp portion 15 thereto. Any type of clasping mechanism, as at 16, may be utilized, to either side, for holding the tongue 15 in place. But, when the fasteners 16 are opened, as can be understood, the tongue 15 may be swiveled about the swivel connection 17 to allow the entire upper vamp to be reversed, in its positioning, and to display different aesthetics, as previously summarized.

Obviously, the style of sandal as shown herein could just as easily be modified, and constructed, for use for domestic services, such as for use as a slipper, or the like, for application around the household. Or, it may be made more into the style of a thong, as previously explained, to be used for casual purposes, or for wearing at the beach, as can also be understood.

Figure 4:
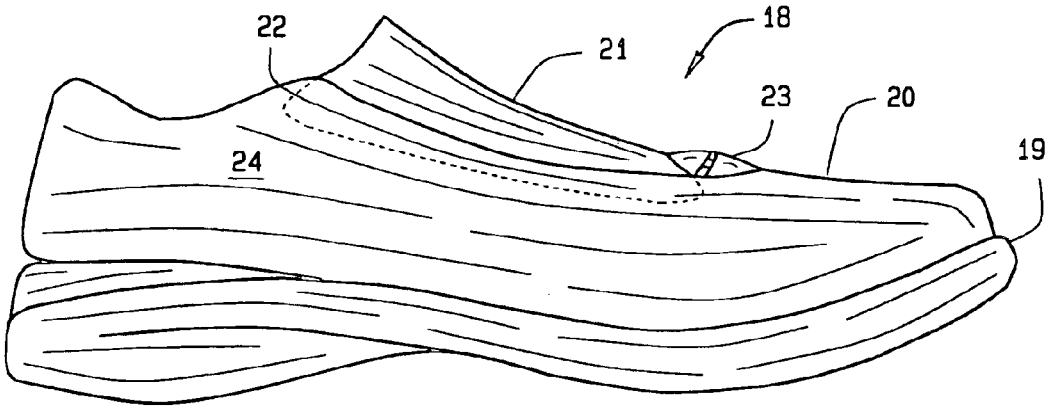
FIG. 4 is a side view of a sandal implementing a reversible tongue or upper vamp according to the present invention wherein the tongue is made from a stretchable material to eliminate the need for lacings.

In FIG. 4, therein is shown a slip-on type of shoe, or sandal, 18, incorporating a sole portion 19, a vamp 20, a tongue 21, and a retaining means 22, provided to either side of the tongue, to fasten the tongue in place, when the slip-on is utilized. In addition, a swivel 23 is provided, in order to allow the tongue 21 to be turned, as desired. The tongue 21 may be made from any known stretchable or resilient type of material, and may be attached by a hook and loop type of fastening means, as at 22, to the quarter portions as at 24, as can be understood. Obviously, there can be an overlap at the region 22, where the fastening means is provided, in order to allow for interconnection for these type components. Or, any type of a hook or loop can be utilized, to simply attach the tongue 21 to the upper quarter portion 24, at these locations, in order to structure the shoe in manner that allows it to be worn, as a sandal. When the wearer wears the sandal of FIG. 4, the stretchable tongue will stretch to provide a tight fit of the sandal, to maintain it on the foot of the wearer, during usage.

Figure 5:
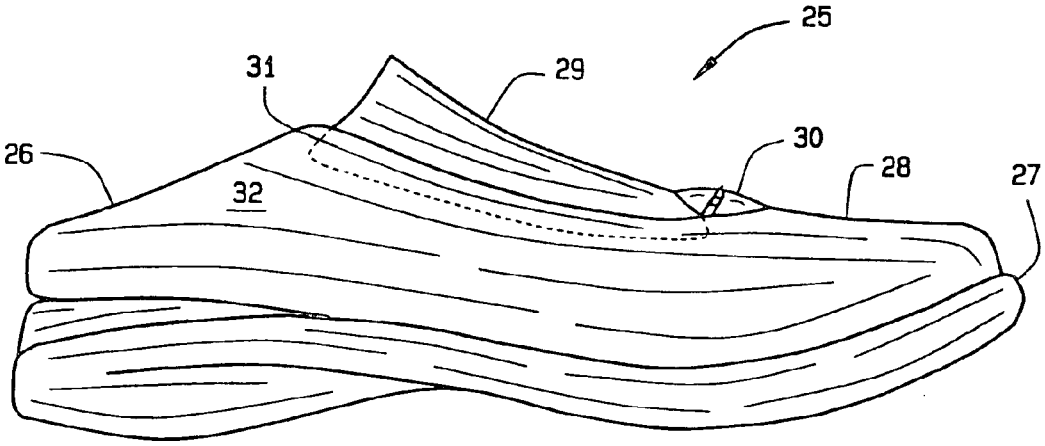
FIG. 5 is a side view of a slip-on implementing a reversible tongue or upper vamp according to the present invention wherein the tongue is made from a stretchable material to eliminate the need for shoe strings or lacings, and having a lower cut clog-type back portion.

In FIG. 5, therein it is shown a slip-on type shoe 25, similar to that as previously explained with respect to FIG. 4, in that its rear portion, as at 26, is low cut, to allow for the foot to be slid onto the sandal, during usage. But, the structured shoe still incorporates a sole 27 having a integrated forward vamp 28, an upper vamp, tongue, or gusset, as at 29, and which is secured by means of the swivel or fastening means 30 to the upper edge of shoe vamp 28. The sides of the tongue 29 may fasten, in the region at 31, to the upper quarter portions 32 of the shown sandal, on each side thereof. When the tongue 29 is freed, from its fastening in the region 31, it may be turned about the swivel 30, to expose its opposite side, as may be desired.

Figure 6:
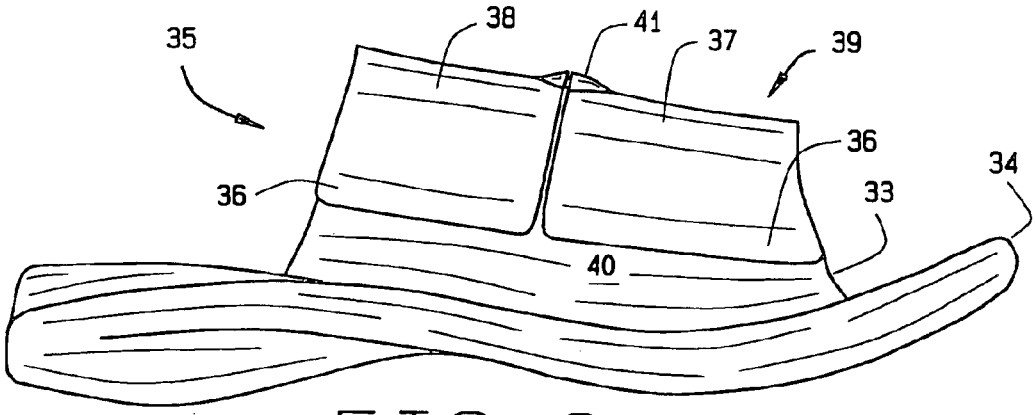
FIG. 6 is a side view of a sandal implementing a reversible double tongue according to the present invention wherein such that four possible color combinations can be shown upon a single sandal.

FIG. 6 shows another sandal 39, which incorporates its sole portion 34 and a vamp portion 33. What is referred to as the tongue portion 35, and while it does not fulfill the traditional purposes of a shoe tongue or gusset, it attaches to the vamp 33 with hook and pile fastening means, or other fasteners, in the region of any overlap, as at 36. The sandal 39 is made of a front tongue section 37, a rear tongue portion 38, attaching by the retaining means 36, as described above. Thus, the entire tongue segment, including its frontal portion 37 and its rear tongue portion 38, will be held in position upon the side portions 40 provided to either side of the shown sandal, and which side portions 40 are integrated into the structure of the sandal sole, as can be noted. In addition, there is a swivel means 41 inserted between the two tongue portions, so that the tongue portion 38 can be rotated, to display different designs, and at the same time, the frontal tongue portion 37 can likewise be removed from its retention means, 36, and also be reversed, to provide for a compound reversing of the entire tongue portions 35, to display four different variations of coloration, design, or other aesthetics. This will be at the preference of the sandal wearer.

Figure 7:
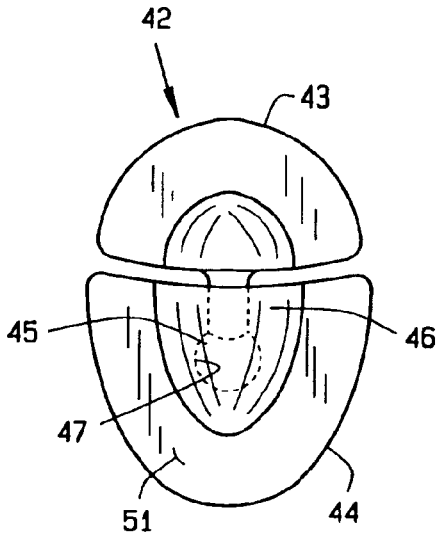
FIG. 7 is a top plan view of the ball and socket attachment, for the swivel, according to the preferred embodiment.
Figure 8:
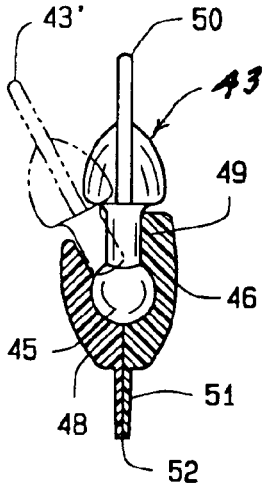
FIG. 8 is a side partially sectional view of the ball and socket attachment according to the preferred embodiment.
Figure 9:
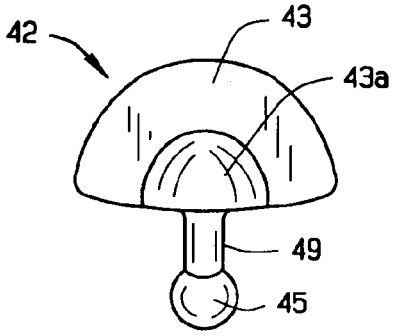
FIG. 9 is a front view of a ball portion according the preferred embodiment.
Figure 10:
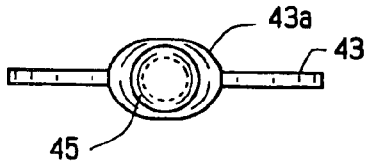
FIG. 10 is a bottom view of a ball portion according to the preferred embodiment.
Figure 11:
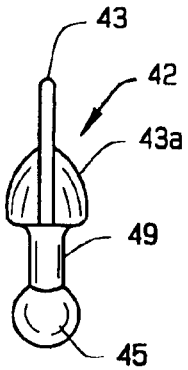
FIG. 11 is a right side view of the socket ball portion according to the preferred embodiment.

In the preferred embodiment, as can be seen in FIG. 7, there is a swivel type mechanism 42 utilized in the structured swivel means provided for allowing turning of the various components for the shown sandals. For example, as can be seen in both FIGS. 7 and 8, ball and socket attachment 42 comprises a ball portion 43, and a socket portion 44, which may be attached to the upper edge of the vamp, or strap, of the type as previously preferred to in the various sandals, as explained at 3 and 7, in FIGS. 1 and 2. This provides a swivel connection for the preferred embodiment, wherein the ball portion 43 is preferably both movable and offset between a position shown by the said ball portion, and a position shown by the ball portion at 43', as disclosed in phantom line, in FIG. 8. Thus, not only is the ball portion rotatable within its socket portion 44, as can be understood, but it is also capable of being inclined, so as to raise the tongue or upper vamp, as it is being turned, and to allow clearance, both for turning of the tongue, but likewise to aid in the insertion of the foot, where required. As a result, the tongue of any sandal is fully rotatable about an axis, generally focused at the center of the ball 45, which allows for a slight incline to the ball portion, as can be noted. The ball portion 45 preferably is made from a resilient polymeric material. In addition, and as previously explained, it may be desired to provide a basis for separation of the ball portion, from within the socket, when the user desired to change gussets or tongues, and that force can be either minimal, or perhaps even at a high strength, as previously explained, so that during shipment, storage, or display upon the market, the tongue can not be too easily removed, by unauthorized persons, until such time as the pair of sandals are sold. In addition, the ball 45 sits within a socket portion 46, that provides a cavity 47 therein, for accommodating the ball 45, in the manner as can be understood. In addition, the socket portion 46 may be formed of two parts, having first side 48 and a second side 49 that may be secured together, to form the cavity 47, as previously explained. The ball portion may include a flange 50, which allows for this part of the swivel to be connected to its sandal component, such as the front of the tongue, upper vamp, or the like, while the bottom portion of the socket 46, formed as the extension tabs 51, and 52, are provided for securing to or stitching with the upper edge of the lower vamp, sole strap, or the like, forming the structured sandals, as previously explained. It can be understood, the swivel may connect along the extension 50 to the lower part of the tongue or gusset, and likewise, the portions or extensions 51 and 52 will be secured to upper edge of the vamp, either by locating it intermediate thereof, or simply being stitched or otherwise secured in place, as can be understood. The portions 51 and 52 may be attached to the vamp of the shoe, in a similar manner as the ball portion 43 may attach to the tongue, gusset, upper vamp, or the like, in the manner as previously explained.

In addition, the diameter of the bore 47 may be selected such that the ball 45 may be forcibly removed from its socket 47 by resiliently deflecting the top part, as noted at 43', with respect to its socket as can be noted. Furthermore, this allows sufficient deflection to provide clearance between the upper vamp or tongue, or strap, as the foot is being inserted into the sandal, or to aid in this removal, as noted. Alternatively, it can be provided that the ball 45 is not removable from the bore 47. In this instance, it can be seen that the socket 47 may be formed of the two halves 45 and 46, as previously explained. These two parts may be adhesively or otherwise secured together, to form the permanent socket 47, as noted. Thus, to provide for a permanent mount of the ball 45 within the socket bore 47, the ball 45 must be placed within the socket before the top and bottom parts 45 and 46 are attached to one another. Or, as previously explained, there may be some slight resiliency in the upper part 43, to allow the ball 45 to be forcibly removed from the socket when it is desired to separate the tongue, upper vamp, or strap, from the shown shoe, as noted. In either instance, it is preferred that the ball 45 and hence the tongue or strap, have sufficient clearance to allow for the tongue to be rotatable by means of its ball 45 within the socket bore 47, in order to expose a second side of the tongue or strap, as can understood. In this manner, the tongue of the shoe may have first and second sides, as may be configured into the structure of any strap that a swivel applies to the lower vamp or sole strap, of differing color, material, designs, and/or displaying indicia, and may be alternatively displayed by the user by mere rotation of the tongue or strap, to achieve the spirit of this invention.

It is further just as likely that the ball and socket connection could be replaced with a bayonet style of locking device, for example, with a bayonet style of swivel locking device, the tongue may be pivoted in one direction, to expose its upper surface from the shoe sole, or it may be pivoted in a 180° (180 degrees) direction, to expose the bottom portion of the shoe tongue or strap. But, at the midpoint or 90° (90 degrees) turn, the stem extending off the ball portion may obtain clearance from the socket for removal of the top part of the bayonet lock, and the tongue, from the vamp or socket. Or, one of that bead style of ball and socket connectors, such as currently available for use in the construction of a necklace, bracelet, or the like, could be adapted for use for swively connecting the tongue or gusset to the vamp portion of the footwear.

Figure 12:
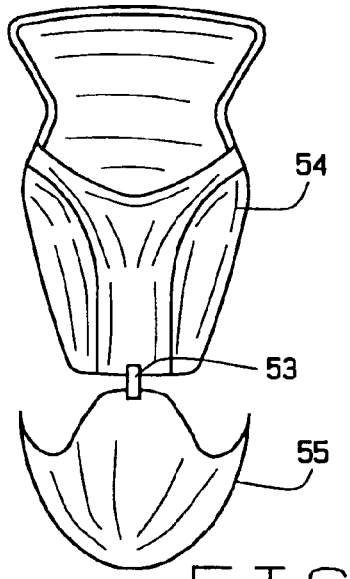
FIG. 12 is a top view of the partial sandal, showing the upper vamp, lower vamp, its reversible upper vamp and tongue, and a link holding the tongue or upper vamp to the sandal, for providing the reversible features of this invention.

The concept of this invention may be generally paraphrased by reviewing FIG. 12. Essentially, the essence of the invention is to provide some linking means, as at 53, that holds the tongue, strap, or other member to be reversed, as at 54, to the upper portion of the sandal vamp, strap, or the like, as at 55, and which may be permanently affixed to the sandal sole, during its construction. Hence, the linking means may be any one of the swivels, an elastic cord, a flexible rubber or polymer, or an elastic means, that allows the tongue to be twisted and reversed, in its setting, during usage. And, as previously explained, the concept of the invention is to also provide that when a swivel is used, one that may possibly be separated, to allow the tongue to actually be removed, and replaced with a substitute tongue, gusset, or strap, for adding further to the design and coloration of the sandal, when worn. Obviously, the reversible tongue or strap can be formed from a variety of materials, whether it be a fabric, polymer, leather, transparent acrylic or polyethylene, and any of such materials which add to the attractiveness to the shoe, but at the same time, provide reasonable strength and sturdiness to withstand constant and repeat usage.

Figure 13:
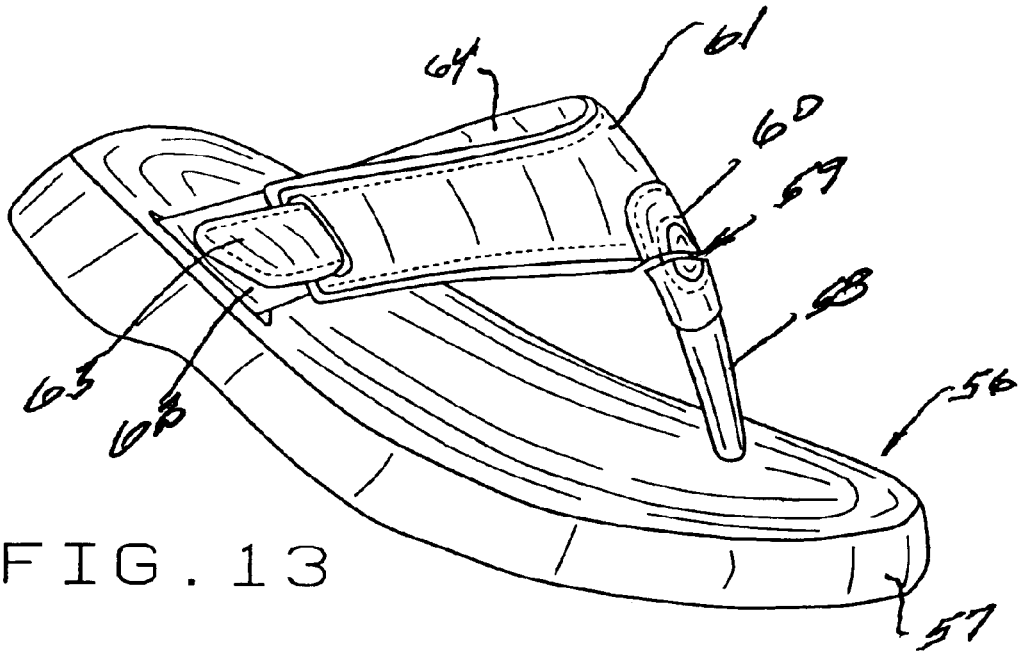
FIG. 13 shows a thong wherein the stem has a swivel provided at its upper end, for attachment with a strap that is capable of being reversed through the functioning of its disclosed swivel.

FIG. 13 shows how the concept of this invention can be applied to a sandal structured in the category of a thong. The thong 56, as shown, is provided with a sole portion 57 as known in the art. Then, a stem 58 stands upwardly from the sole, and normally, in a thong, this becomes a toe strap or stem that extends between various of the toes of the foot, when the thong sandal is worn. At the upper end of the stem there is provided a swivel 59 similar to those as previously described with respect to FIGS. 7 through 11. The upper part 60 of the swivel connects with a strap 61, and the strap then extends rearwardly for connection to the sole fasteners 62, one being provided to either side of the shown thong, secured in place by means of any type of a fastening means, such as a supplemental strap held by Velcro, as at 63, or a buckle, or any other type of fastening means. Similar types of fastening means will be provided wherein the strap, as at 64, extends to the opposite side of the thong sole, so that it likewise can be loosened. When both of the fastening means 63 are opened, the strap 61 can be turned about its swivel 59, so as to expose its other surface, which may include a differing coloration, indicia, design, or the like, within the concept of this invention.

Figure 14:
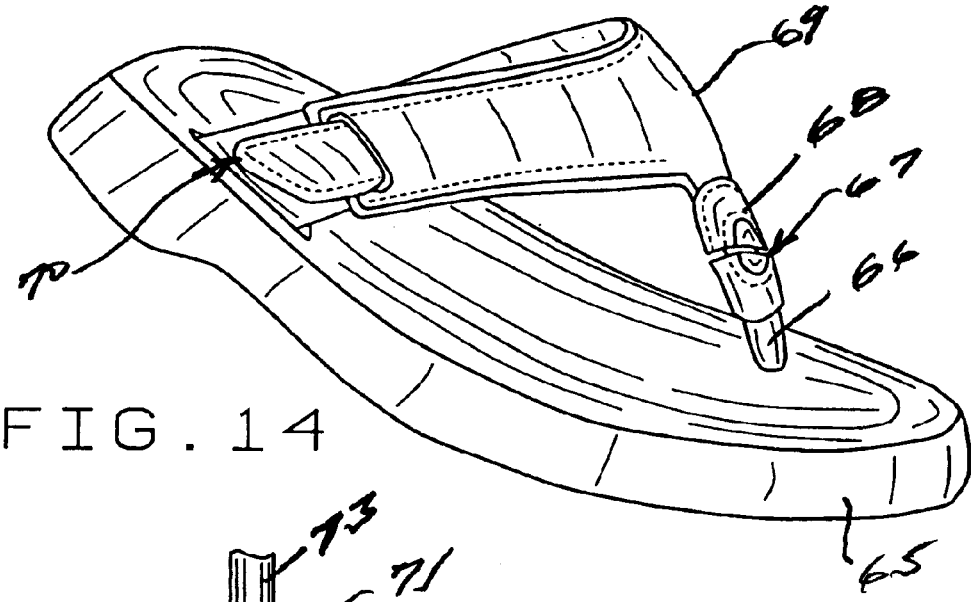
FIG. 14 shows a thong having a stem, with a swivel integrated within its structure, for holding the strap of the thong in place, but allowing for its pivotal reversing, as required.

A similar type of structure is shown in FIG. 14, where the sole 65 of the shown sandal thong includes a shallow stem 66, having its swivel 67 arranged intermediate thereof, and which extends upward, as at its upper swivel portion 68 in connection with the reversible strap 69, in the manner as previously explained. Once again, various types of fasteners, one as shown at 70, can be provided to either side of the thong, to allow for loosening, and turning of the strap 69, to change its appearance.

Figure 15:
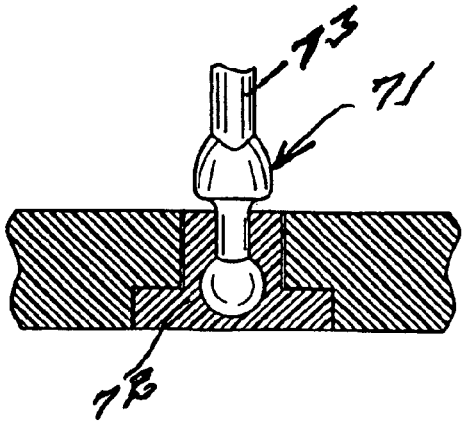
FIG. 15 shows the swivel of this invention interconnected within the thong cap that holds the lower end of its stem to and through the thong sole, during its usage.

A further method of connecting the swivel to the upper part of the sole as shown at 71, in FIG. 15, and discloses how that upper part of the swivel may connect into the cap portion as at 72, that connects with the sole of the thong, to hold its stem, as at 73, in place. Thus, with a strap, similar to those as previously explained with respect to the straps 61 and 69, provided at the upper end of the stem 73, such a strap can be reversed and turned in position, through the agency of its swivel component 71, that embeds within the cap portion of the stem, and affixes it to the thong sole, as can be seen.

Figure 16:
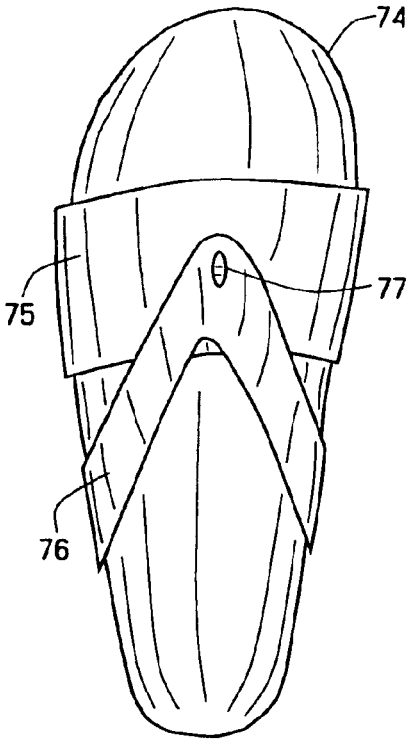
FIG. 16 is a plan view of a modification to a sandal showing its strap being swively connected to its sole vamp, or strap.

Other variations upon the structure of this type of sandal or thong can be seen in FIG. 16, where the sandal sole 74 includes a sole strap 75, affixed thereto, and includes a foot strap 76 held by the swivel 77, so that when the foot strap 76 is opened, it can be swiveled and turned in position so as to expose its opposite side.

Figure 17:
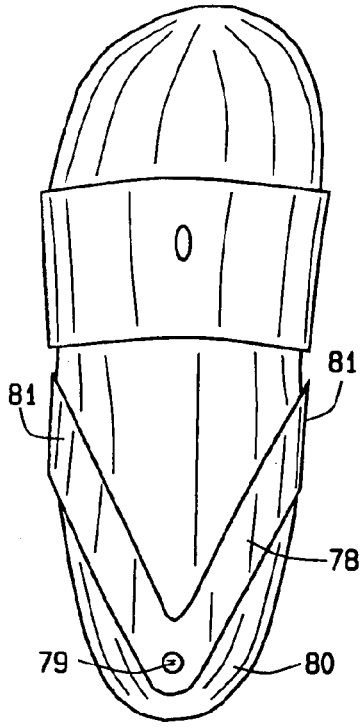
FIG. 17 shows a modification to a sandal wherein its sandal strap is swively connected to a back end of the sandal sole.

In addition, FIG. 17 shows how the sandal strap 78 may be affixed by a swivel, as at 79, to the back end of the sandal sole, as at 80, so that when the fastening means, such as Velcro, arranged at the frontal edge of the strap 78, as at 81, is opened, the strap may be pivoted in place, to expose its reverse side, and to change the appearance and aesthetics of the sandal, upon which the structure attaches.

Figure 18:
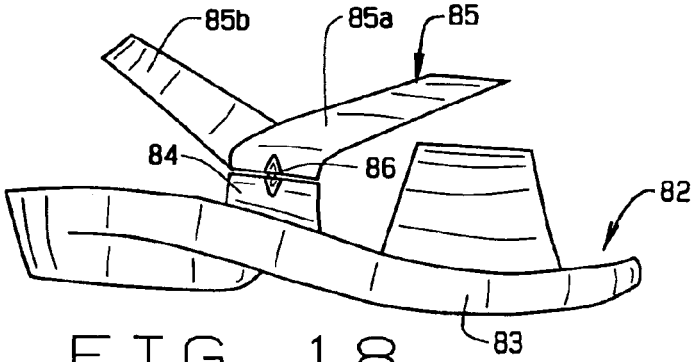
FIG. 18 is a side view of a modification to a sandal disclosing its sandal strap being pivotally connected to each lateral extensions of the sandal sole.

FIG. 18 shows how the securing straps for the shown sandal 82 may connect to either side of the sandal sole 83, as along the short length of the foot strap 84 one of which connects to either lateral edge of the shown sole, and has the strap 85 connected by the swivels 86, at each sole, so the strap may be turned in place, to reveal its reverse side, whether the strap is used to embrace the forward portion of the foot, as noted at 85A, or shifted approximately 120° (120 degrees), for embracing the back edge of the heel or ankle, as at 85B, to locate the sandal in that manner.

Figure 19:
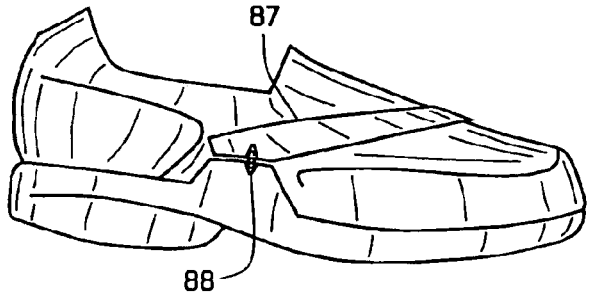

FIG. 19 discloses how a similar type of strap, as at 87 can be used with an athletic, work, or walking shoe, and extend forwardly, in the manner as shown, or be reversed and turned, by way of its swivels 88 and extend rearwardly, in the manner as shown and described for the strap 85B, of FIG. 18.

Variations or modifications to the subject matter of this invention may occur to those skilled in the art upon reviewing the disclosure as provided herein. Such variations, if within the spirit of this development, are intended to be encompassed with in scope of any claims to invention provided within this patent. The description of the preferred embodiment, as also depicted in the drawings, is set forth herein for illustrative purposes only.

What is claimed is:

1. A sandal comprising:

a thong having a sole, a thong stem, and a thong strap, all capable of securement together, the stem incorporating a swivel means within its structure, said swivel means having a ball and socket attachment further comprising a ball portion rotatably secured within a socket portion such that the thong strap may be rotated about a first axis without deformation while still attached to the thong stem so that the thong strap can be rotated to expose its opposite surfaces for varying the aesthetics of the sandal when worn.

2. The thong of claim 1 further comprising: the swivel means being provided at the midpoint of the thong stem, said ball portion attaching to the thong strap and the socket portion attaching to the thong stem.

3. The thong of claim 1 further comprising: the swivel means being provided at the upper end of thong stem and, the ball portion attaching to the thong strap and the socket portion attaching to the thong stem.

4. The thong of claim 1 further comprising: the swivel means being provided at the bottom of the thong stem, and the ball portion attaching to the thong stem and the socket portion attaching to the sole thus adhering the stem to the sole of the thong.

* * * * *